US011400704B2

(12) United States Patent
Rossi et al.

(10) Patent No.: US 11,400,704 B2
(45) Date of Patent: Aug. 2, 2022

(54) EMULATING PARAMETERS OF A FLUID EJECTION DIE

(71) Applicant: HEWLETT-PACKARD DEVELOPMENT COMPANY, L.P., Spring, TX (US)

(72) Inventors: John Rossi, Vancouver, WA (US); Eric D. Ness, Vancouver, WA (US); James Michael Gardner, Corvallis, OR (US); Scott A. Linn, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 3 days.

(21) Appl. No.: 16/772,978

(22) PCT Filed: Feb. 6, 2019

(86) PCT No.: PCT/US2019/016832
§ 371 (c)(1),
(2) Date: Jun. 15, 2020

(87) PCT Pub. No.: WO2020/162923
PCT Pub. Date: Aug. 13, 2020

(65) Prior Publication Data
US 2021/0213729 A1 Jul. 15, 2021

(51) Int. Cl.
*B41J 2/045* (2006.01)

(52) U.S. Cl.
CPC ..... *B41J 2/0454* (2013.01); *B41J 2/04541* (2013.01); *B41J 2/04546* (2013.01); *B41J 2/04563* (2013.01); *B41J 2/04586* (2013.01)

(58) Field of Classification Search
CPC ... B41J 2/362; B41J 2/0452; B41J 2/32; B41J 2/365
See application file for complete search history.

(56) References Cited

U.S. PATENT DOCUMENTS 4,680,780 A 7/1987 Agoston et al.
5,012,494 A 4/1991 Lai et al.
(Continued)

FOREIGN PATENT DOCUMENTS

CN 102176199 A 9/2011
CN 108367568 A 8/2018
(Continued)

OTHER PUBLICATIONS

Hewlett-Packard Development Company, L.P., Int. Appl. No. PCT/US2019/016734 entitled Data Packets Comprising Random Numbers for Controlling Fluid Dispensing Devices filed Feb. 6, 2019 (33 pages).
(Continued)

*Primary Examiner* — Lam S Nguyen
(74) *Attorney, Agent, or Firm* — Dicke Billig & Czaja PLLC

(57) ABSTRACT

An integrated circuit includes thermal tracking logic, control logic, and an output interface. The thermal tracking logic determines a temperature of a fluid ejection die. The control logic defines an emulated parameter of the fluid ejection die as a function of the temperature of the fluid ejection die. The output interface outputs the emulated parameter to a printer system based on the function and the temperature of the fluid ejection die.

10 Claims, 7 Drawing Sheets

(56) References Cited

U.S. PATENT DOCUMENTS

| | | | | |
|---|---|---|---|---|
| 5,422,662 | A | 6/1995 | Fukushima et al. | |
| 5,699,515 | A | 12/1997 | Berkema | |
| 5,760,797 | A | 6/1998 | Koizumi | |
| 5,838,749 | A | 11/1998 | Casper et al. | |
| 5,850,422 | A | 12/1998 | Chen | |
| 6,102,510 | A | 8/2000 | Kikuta | |
| 6,128,098 | A | 10/2000 | Kamada et al. | |
| 6,168,252 | B1 | 1/2001 | Masao | |
| 6,266,799 | B1 | 7/2001 | Lee et al. | |
| 7,159,959 | B2 | 1/2007 | Schremp et al. | |
| 7,419,236 | B2 | 9/2008 | Masuda | |
| 7,738,137 | B2 | 6/2010 | Graf et al. | |
| 7,866,778 | B2 | 1/2011 | Silverbrook et al. | |
| 8,556,364 | B2 | 10/2013 | Hoisington et al. | |
| 8,777,364 | B2 | 7/2014 | Carrobe et al. | |
| 9,415,585 | B1 | 8/2016 | Goyen et al. | |
| 9,597,894 | B2 | 3/2017 | Buxton et al. | |
| 9,676,180 | B2 | 6/2017 | Gracia Verdugo et al. | |
| 9,701,116 | B2 | 7/2017 | Van Brocklin | |
| 9,738,092 | B2 * | 8/2017 | Takahashi | B41J 2/362 |
| 9,776,395 | B2 | 10/2017 | Anderson et al. | |
| 2003/0142159 | A1 | 7/2003 | Askeland | |
| 2005/0105591 | A1 | 5/2005 | Egan | |
| 2005/0253894 | A1 | 11/2005 | Smektala | |
| 2006/0071964 | A1 | 4/2006 | Oku | |
| 2006/0152572 | A1 | 7/2006 | Kasai | |
| 2006/0159502 | A1 * | 7/2006 | Saquib | B41J 2/32 400/120.01 |
| 2007/0064083 | A1 | 3/2007 | Saquib et al. | |
| 2008/0136859 | A1 | 6/2008 | Kim et al. | |
| 2009/0175310 | A1 * | 7/2009 | Saquib | B41J 2/365 374/11 |
| 2010/0124329 | A1 | 5/2010 | Lyman et al. | |
| 2010/0322249 | A1 | 12/2010 | Thathapudi et al. | |
| 2012/0025845 | A1 | 2/2012 | Carrobe et al. | |
| 2012/0236056 | A1 | 9/2012 | Ito | |
| 2013/0321507 | A1 | 12/2013 | Mardilovich et al. | |
| 2016/0236466 | A1 | 8/2016 | Takahashi et al. | |
| 2017/0096002 | A1 | 4/2017 | Koerner et al. | |
| 2018/0370227 | A1 | 12/2018 | Hayashi | |

FOREIGN PATENT DOCUMENTS

| | | | |
|---|---|---|---|
| CN | 109070616 | A | 12/2018 |
| EP | 0972374 | A1 | 1/2000 |
| JP | H02208052 | A | 8/1990 |
| JP | 2002-127405 | A | 5/2002 |
| JP | 2008137237 | A | 6/2008 |
| KR | 20080006823 | A | 1/2008 |
| TW | 201637880 | A | 11/2016 |
| WO | WO-2013158105 | A1 | 10/2013 |

OTHER PUBLICATIONS

What is a Kelvin connection and when should it be used? Dated on or before Jan. 2019 (2 pages).

Wikipedia, Four-terminal sensing last edited Sep. 16, 2018 (3 pages).

* cited by examiner

EMULATING PARAMETERS OF A FLUID EJECTION DIE

CROSS-REFERENCE TO RELATED APPLICATIONS

This application is a U.S. National Stage Application of PCT Application No. PCT/US2019/016832, filed Feb. 6, 2019, entitled "EMULATING PARAMETERS OF A FLUID EJECTION DIE".

BACKGROUND

An inkjet printing system, as one example of a fluid ejection system, may include a printhead, an ink supply which supplies liquid ink to the printhead, and an electronic controller which controls the printhead. The printhead, as one example of a fluid ejection device, ejects drops of ink through a plurality of nozzles or orifices and toward a print medium, such as a sheet of paper, so as to print onto the print medium. In some examples, the orifices are arranged in at least one column or array such that properly sequenced ejection of ink from the orifices causes characters or other images to be printed upon the print medium as the printhead and the print medium are moved relative to each other.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Parameter shift characterization may be used to validate the integrity of a device to enable fluid ejection (e.g., a fluid ejection die). A fluid ejection system (e.g., a printer) may employ parameter shift characterization using a defined approach that may be configured for a specific device and/or printhead technology. This defined approach for a system may limit flexibility and compatibility with existing systems.

Accordingly, disclosed herein is an integrated circuit between a printer system and a fluid ejection die to emulate parameters of the fluid ejection die based on the temperature of the die. Each parameter may be initialized by measuring or inferring the temperature of the die and defining the parameter as a function based on temperature. After initialization, each parameter may be emulated based on measured or inferred temperature via a closed loop thermal control of the emulated parameter. The emulated parameter may be a voltage, a current, or a resistance.

Figure 1:
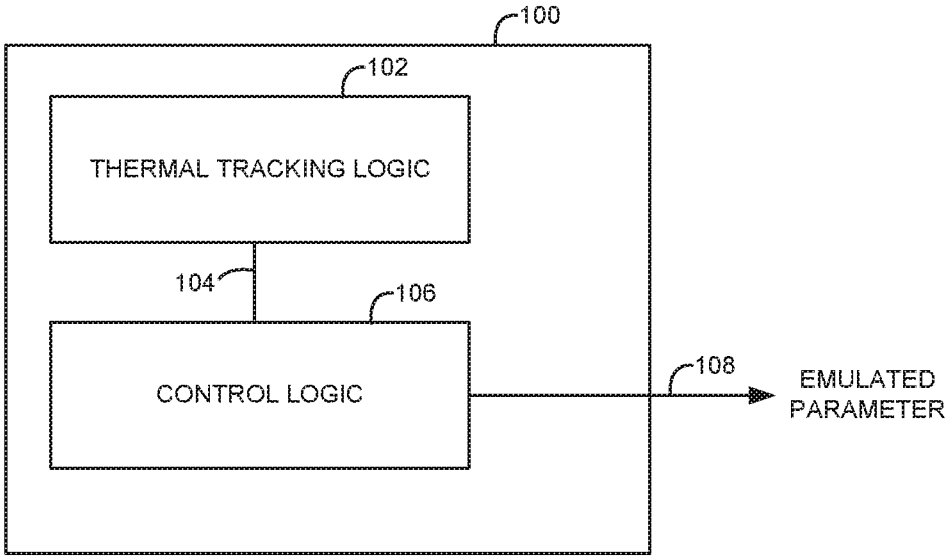
FIG. 1 is a block diagram illustrating one example of an integrated circuit for emulating a parameter.

FIG. 1 is a block diagram illustrating one example of an integrated circuit 100 for emulating a parameter. In one example, integrated circuit 100 may be electrically coupled between a fluid ejection die as will be described below with reference to FIGS. 8A and 8B and a fluid ejection system as will be described below with reference to FIG. 9. Integrated circuit 100 includes thermal tracking logic 102, control logic 106, and an output interface 108. Thermal tracking logic 102 is electrically coupled to control logic 106 through a signal path 104. Control logic 106 is electrically coupled to output interface 108.

Thermal tracking logic 102 determines a temperature of a fluid ejection die. In one example, thermal tracking logic 102 measures the temperature of the fluid ejection die. In another example, thermal tracking logic 102 estimates the temperature of the fluid ejection die based on a thermal model. The thermal model may estimate the temperature of the fluid ejection die based on influences such as thermal capacitance, warming power, ambient temperature, etc. of the fluid ejection die. The thermal model may be used to calculate a temperature increase when warming of the fluid ejection die is enabled and a temperature decrease when warming of the fluid ejection die is disabled.

Control logic 106 defines an emulated parameter of the fluid ejection die as a function of the temperature of the fluid ejection die. The emulated parameter may be, for example, a resistance, a voltage, or a current. The output interface 108 outputs the emulated parameter to a printer system based on the function and the temperature of the fluid ejection die.

Control logic 102 may include a microprocessor, an application-specific integrated circuit (ASIC), or other suitable logic circuitry for controlling the operation of integrated circuit 100. Output interface 108 may be a contact pad, a pin, a bump, a wire, or another suitable electrical interface for outputting an emulated parameter from control logic 106.

Figure 2:
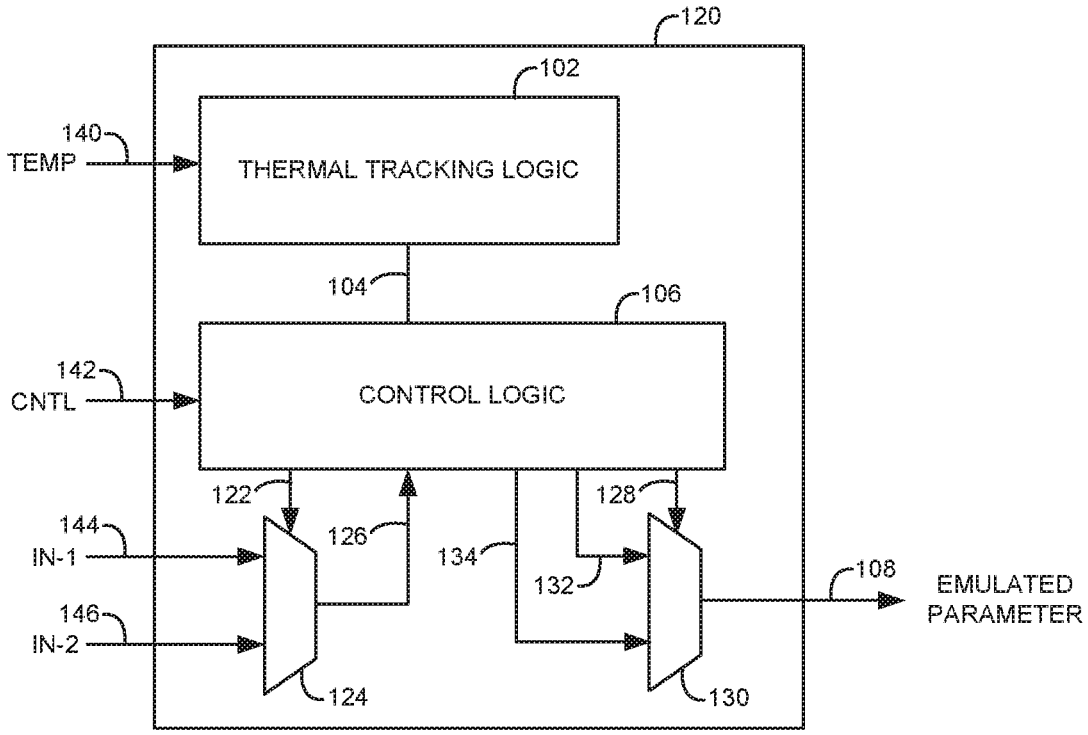
FIG. 2 is a block diagram illustrating another example of an integrated circuit for emulating a parameter.

FIG. 2 is a block diagram illustrating another example of an integrated circuit 120 for emulating a parameter. In one example, integrated circuit 120 may be electrically coupled between a fluid ejection die as will be described below with reference to FIGS. 8A and 8B and a fluid ejection system as will be described below with reference to FIG. 9. Integrated circuit 120 is similar to integrated circuit 100 previously described and illustrated with reference to FIG. 1 and includes thermal tracking logic 102, control logic 106, and output interface 108. In addition, integrated circuit 120 also includes multiplexers 124 and 130, a temperature (TEMP) input interface 140, a control (CNTL) input interface 142, and a plurality of input interfaces including a first (IN-1) input interface 144 and a second (IN-2) input interface 146.

The temperature input interface 140 is electrically coupled to the thermal tracking logic 102. The control input interface 142 is electrically coupled to the control logic 106.

Control logic 106 is electrically coupled to a control input of multiplexer 124 through a signal path 122. The first input interface 144 and the second input interface 146 are electrically coupled to inputs of the multiplexer 124. The output of the multiplexer 124 is electrically coupled to an input of control logic 106. Control logic 106 is electrically coupled to a control input of multiplexer 130 through a signal path 128, and to a first input and a second input of multiplexer 130 through signal paths 132 and 134, respectively. The output of the multiplexer 130 is electrically coupled to the output interface 108.

Temperature interface 140 may be used to measure the temperature of a fluid ejection die. Temperature interface 140 may be electrically coupled to an internal thermal sensing element of a fluid ejection die (e.g., a temperature sensing resistor, a temperature sensing diode stack, or another suitable integrated temperature sensing element) or electrically coupled to an external temperature sensor (e.g., a thermocouple) external to a fluid ejection die to measure the temperature of the fluid ejection die. Control interface 142 may be electrically coupled to a fluid ejection system (e.g., a printer) to receive control signals indicating which parameter is to be emulated. Input interfaces 144 and/or 146 may be used to measure a parameter of a fluid ejection die to be emulated.

Control logic 106 receives the control signal and may provide a signal on signal path 122 to multiplexer 124 to select the input interface 144 or 146 corresponding to the received control signal on control interface 142. The parameter on the selected input interface is then measured by control logic 106 through signal path 126. Control logic 106 may modify the measured parameter based on the temperature of the fluid ejection die and a desired temperature dependency (e.g., linear or nonlinear) to define the emulated parameter as a function of the temperature of the fluid ejection die.

Control logic 106 may pass emulated parameters to multiplexer 130 through signal paths 132 and 134. Control logic 106 may provide a signal on signal path 128 to multiplexer 130 to select the emulated parameter on signal path 132 or 134 corresponding to the received control signal on control interface 142. The selected emulated parameter is then passed to output interface 108. Thus, multiplexer 124 may select one of the plurality of input interfaces (i.e., 144 or 146) based on a control signal on the control interface 142. Multiplexer 130 may output one of a plurality of emulated parameters on the output interface 108 based on a control signal on the control interface 142.

Figure 3:
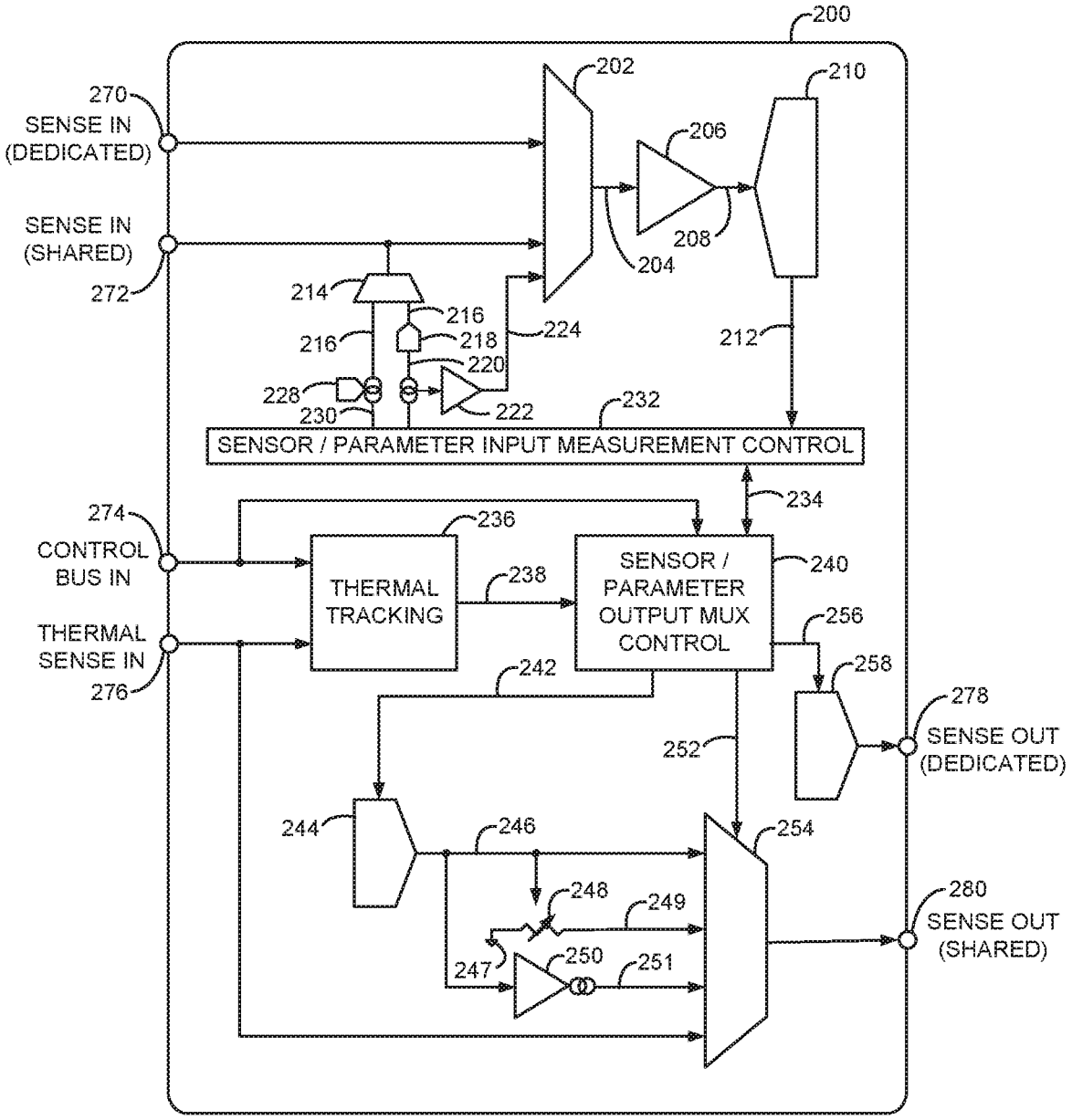
FIG. 3 is a schematic diagram illustrating another example of an integrated circuit for emulating a parameter.

FIG. 3 is a schematic diagram illustrating another example of an integrated circuit 200 for emulating a parameter. In one example, integrated circuit 200 may be electrically coupled between a fluid ejection die as will be described below with reference to FIGS. 8A and 8B and a fluid ejection system as will be described below with reference to FIG. 9. Integrated circuit 200 may include analog multiplexers 202, 214, and 254, a programmable gain amplifier 206, an analog to digital converter (ADC) 210, voltage mode digital to analog converters (DACs) 218, 244, and 258, a current mode digital to analog converter (iDAC) 228, a transimpedance amplifier (TIA) 222, sensor/parameter input measurement control logic 232, thermal tracking logic 236, sensor/parameter output multiplexer control logic 240, a digital potentiometer 248, and a transconductance amplifier (TCA) 250. Integrated circuit 200 may also include a dedicated sense input interface 270 to receive a voltage parameter, a shared sense input interface 272 to receive any one of a plurality of parameters, a control bus input interface 274 to receive a signal indicating a parameter to be emulated, a thermal sense input interface 276 to receive a temperature signal or a signal for estimating a temperature, a dedicated sense output interface 278 to output an emulated parameter, and a shared sense output interface 280 to output any one of a plurality of emulated parameters.

The dedicated sense input interface 270 and the shared sense input interface 272 are electrically coupled to inputs of analog multiplexer 202. The output of analog multiplexer 202 is electrically coupled to the input of programmable gain amplifier 206 through a signal path 204. The output of programmable gain amplifier 206 is electrically coupled to the input of analog to digital converter 210 through a signal path 208. The output of analog to digital converter 210 is electrically coupled to an input of sensor/parameter input measurement control logic 232 through a signal path 212.

An output of sensor/parameter input measurement control logic 232 is electrically coupled to the input of current mode digital to analog converter 228 through a signal path 230. The output of current mode digital to analog converter 228 is electrically coupled to an input of analog multiplexer 214 through a signal path 216. Another output of sensor/parameter input measurement control logic 232 is electrically coupled to the input of transimpedance amplifier 222 and an input of voltage mode digital to analog converter 218 through a signal path 220. The output of voltage mode digital to analog converter 218 is electrically coupled to another input of analog multiplexer 214 through a signal path 216. The output of analog multiplexer 214 is electrically coupled to shared sense input interface 272. The output of transimpedance amplifier 222 is electrically coupled to an input of analog multiplexer 202 through a signal path 224.

Sensor/parameter input measurement control logic 232 is electrically coupled to sensor/parameter output multiplexer control logic 240 through a signal path 234. Control bus input interface 274 is electrically coupled to an input of thermal tracking logic 236 and an input of sensor/parameter output multiplexer control logic 240. Thermal sense input interface 276 is electrically coupled to an input of thermal tracking logic 236 and an input of analog multiplexer 254. An output of thermal tracking logic 236 is electrically coupled to an input of sensor/parameter output multiplexer control logic 240 through a signal path 238. Sensor/parameter output multiplexer control logic 240 is electrically coupled to the input of voltage mode digital to analog converter 244 through a signal path 242, the control input of analog multiplexer 254 through a signal path 252, and the input of voltage mode digital to analog converter 258 through a signal path 256. The output of voltage mode digital to analog converter 258 is electrically coupled to the dedicated sense output interface 278.

The output of voltage mode digital to analog converter 244 is electrically coupled to an input of analog multiplexer 254, a control input of digital potentiometer 248, and the input of transconductance amplifier 250 through a signal path 246. One side of digital potentiometer 248 is electrically coupled to a common or ground 247 and the other side of digital potentiometer 248 is electrically coupled to an input of analog multiplexer 254 through a signal path 249. The output of transconductance amplifier 250 is electrically coupled to an input of analog multiplexer 254 through a signal path 251. The output of analog multiplexer 254 is electrically coupled to the shared sense output interface 280.

Analog multiplexer 202 passes one of the voltage inputs from dedicated sense input interface 270, shared sense input interface 272, or transimpedance amplifier 222 to programmable gain amplifier 206. Programmable gain amplifier 206 may scale the output of analog multiplexer 202 to the input range of the analog to digital converter 210. Analog to digital converter 210 creates an output code that represents the input voltage. This code is passed to sensor/parameter input measurement control logic 232. In one example, analog to digital converter 210 is a 10 bit analog to digital converter. Sensor/parameter input measurement control logic 232 may pass the code from analog to digital converter 210 to sensor/parameter output multiplexer control logic 240.

A parameter to be emulated may be received for measurement on either the dedicated sense input interface 270 or the shared sense input interface 272. In this example, the dedicated sense input interface 270 has voltage measurement capability for voltage parameters, while the shared sense input interface 272 includes voltage, current, and resistance measurement capability for voltage parameters, current parameters, and resistance parameters. For voltage measurements, the voltage parameter received on dedicated sense input interface 207 or shared sense input interface 272 is passed to analog multiplexer 202 and converted to a code that represents the voltage parameter by analog to digital converter 210.

For current measurements, a voltage is applied to the shared sense input interface 272 via the voltage mode digital to analog converter 218 and the analog multiplexer 214. The current flowing from the voltage mode digital to analog converter 218 is converted to a voltage via the transimpedance amplifier 222. This voltage is then passed to analog multiplexer 202 and converted to a code that represents the current parameter by analog to digital converter 210. For resistance measurements, a current is applied to the shared sense input interface 272 via the current mode digital to analog converter 228 and the analog multiplexer 214. The resulting voltage on shared sense input interface 272 is passed to analog multiplexer 202 and converted to a code that represents the resistance parameter by analog to digital converter 210.

Thermal tracking logic 236 measures or estimates the temperature of the fluid ejection die based on the signals on the control bus input interface 274 and the thermal sense input interface 276. Thermal tracking logic 236 passes the measured or estimated temperature to sensor/parameter output multiplexer control logic 240. Sensor/parameter output multiplexer control logic 240 generates a code corresponding to an emulated parameter based on the measured or estimated temperature, the signal on the control bus input interface 274 indicating the parameter to be emulated, the measured parameter (i.e., for an adaptive system to be described below with reference to FIG. 6) from sensor/parameter input measurement control logic 232, and the desired thermal dependency. In one example, the code corresponding to the emulated parameter is passed to voltage mode digital to analog converter 258, which converts the code to an emulated voltage parameter and outputs the emulated voltage parameter on dedicated sense output interface 278. In another example, voltage mode digital to analog converter 258 may be replaced with a current mode digital to analog converter to convert the code corresponding to the emulated parameter to an emulated current parameter for output on dedicated sense output interface 278.

The code corresponding to an emulated parameter may also be passed to voltage mode digital to analog converter 244, which converts the code to a voltage corresponding to the emulated parameter. In this case, the emulated parameter may be a voltage parameter, a current parameter, or a resistance parameter. Sensor/parameter output multiplexer control logic 240 controls analog multiplexer 254. In one example, analog multiplexer 254 passes the voltage corresponding to the emulated parameter on signal path 246 to shared sense output interface 280 to provide an emulated voltage parameter. In another example, analog multiplexer 254 passes a resistance from digital potentiometer 248, which is controlled by the voltage corresponding to the emulated parameter on signal path 246, to shared sense output interface 280 to provide an emulated resistance parameter. In another example, analog multiplexer 254 passes a current from the transconductance amplifier 250, which is set by the voltage corresponding to the emulated parameter on signal path 246, to shared sense output interface 280 to provide an emulated current parameter. In another example, analog multiplexer 254 passes the temperature signal on the thermal sense input interface 276 to the shared sense output interface 280 to provide a pass-through function for the temperature signal.

While sensor/parameter input measurement control logic 232, thermal tracking logic 236, and sensor/parameter output multiplexer control logic 240 are shown in FIG. 3 as separate control logic blocks, in other examples control logic blocks 232, 236, and 240 may be combined. Each control logic block 232, 236, and 240 or combinations thereof may be provided by a microprocessor, an ASIC, or other suitable logic circuitry for controlling the operation of integrated circuit 200.

Figure 4A:
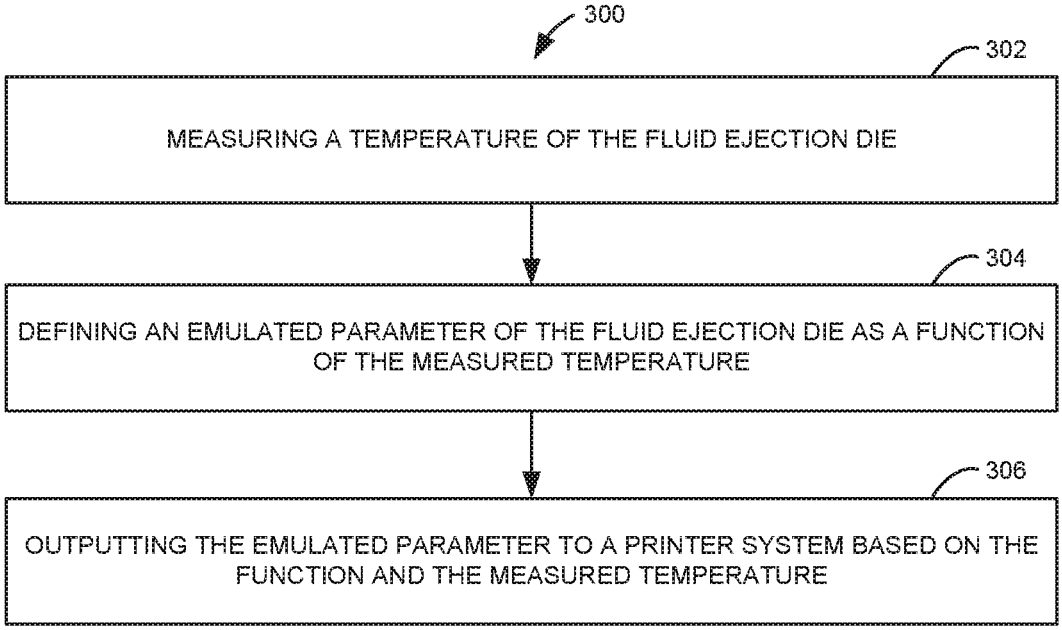
FIGS. 4A and 4B are flow diagrams illustrating one example of a method for emulating a parameter of a fluid ejection die.
Figure 4B:
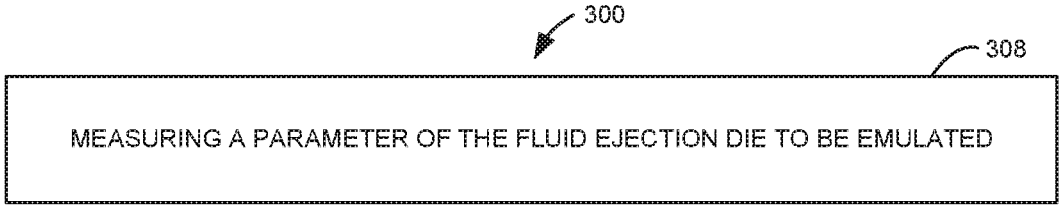

FIGS. 4A and 4B are flow diagrams illustrating one example of a method 300 for emulating a parameter of a fluid ejection die. In one example, method 300 may be implemented by integrated circuit 100 of FIG. 1, integrated circuit 120 of FIG. 2, or integrated circuit 200 of FIG. 3. As illustrated in FIG. 4A, at 302 method 300 includes measuring a temperature of the fluid ejection die. In one example, measuring the temperature of the fluid ejection die includes measuring the temperature of the fluid ejection die via a temperature sensor external to the fluid ejection die. At 304, method 300 includes defining an emulated parameter of the fluid ejection die as a function of the measured temperature. In one example, the emulated parameter includes a resistance, a voltage, or a current. At 306, method 300 includes outputting the emulated parameter to a printer system based on the function and the measured temperature. In one example, outputting the emulated parameter includes outputting the emulated parameter via a voltage mode digital to analog converter, a current mode digital to analog converter, a transconductance amplifier, or a digital potentiometer.

As illustrated in FIG. 4B, at 308 method 300 may further include measuring a parameter of the fluid ejection die to be emulated. In this case, defining the emulated parameter may include modifying the measured parameter based on the measured temperature to define the emulated parameter as the function of the measured temperature.

Figure 5:
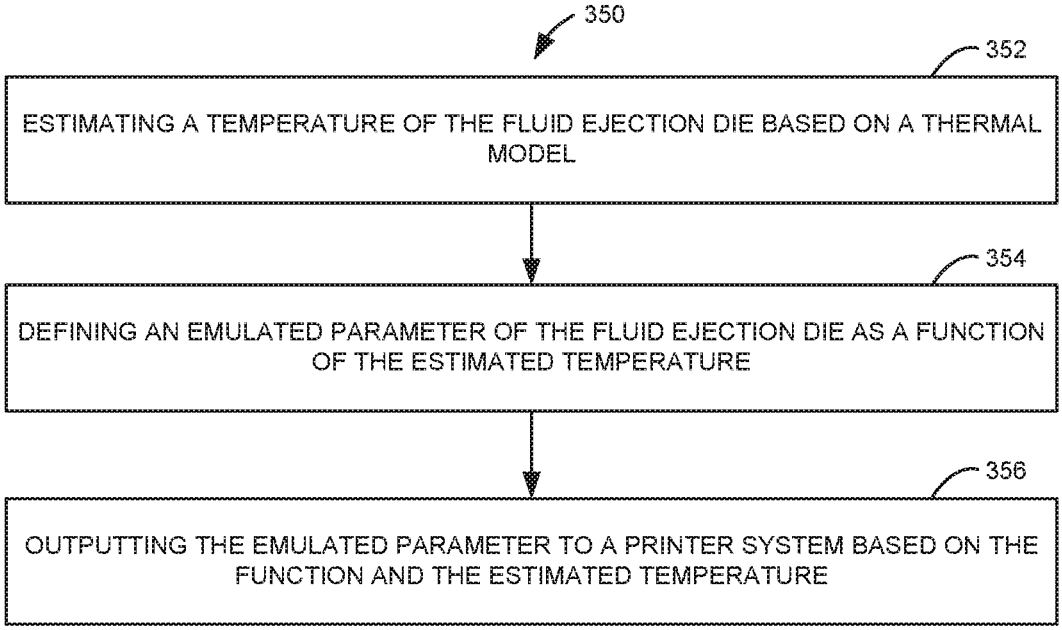
FIG. 5 is a flow diagram illustrating another example of a method for emulating a parameter of a fluid ejection die.

FIG. 5 is a flow diagram illustrating another example of a method 350 for emulating a parameter of a fluid ejection die. In one example, method 350 may be implemented by integrated circuit 100 of FIG. 1, integrated circuit 120 of FIG. 2, or integrated circuit 200 of FIG. 3. At 352, method 350 includes estimating a temperature of the fluid ejection die based on a thermal model. In one example, estimating the temperature includes monitoring a thermal control loop controlling heating of the fluid ejection die. The thermal model may estimate the temperature based on whether heating of the fluid ejection die is enabled or disabled. At 354, method 350 includes defining an emulated parameter of the fluid ejection die as a function of the estimated temperature. In one example, the emulated parameter includes a resistance, a voltage, or a current. At 356, method 350 includes outputting the emulated parameter to a printer system based on the function and the estimated temperature. In one example, outputting the emulated parameter includes outputting the emulated parameter via a voltage mode digital to analog converter, a current mode digital to analog converter, a transconductance amplifier, or a digital potentiometer.

Figure 6:
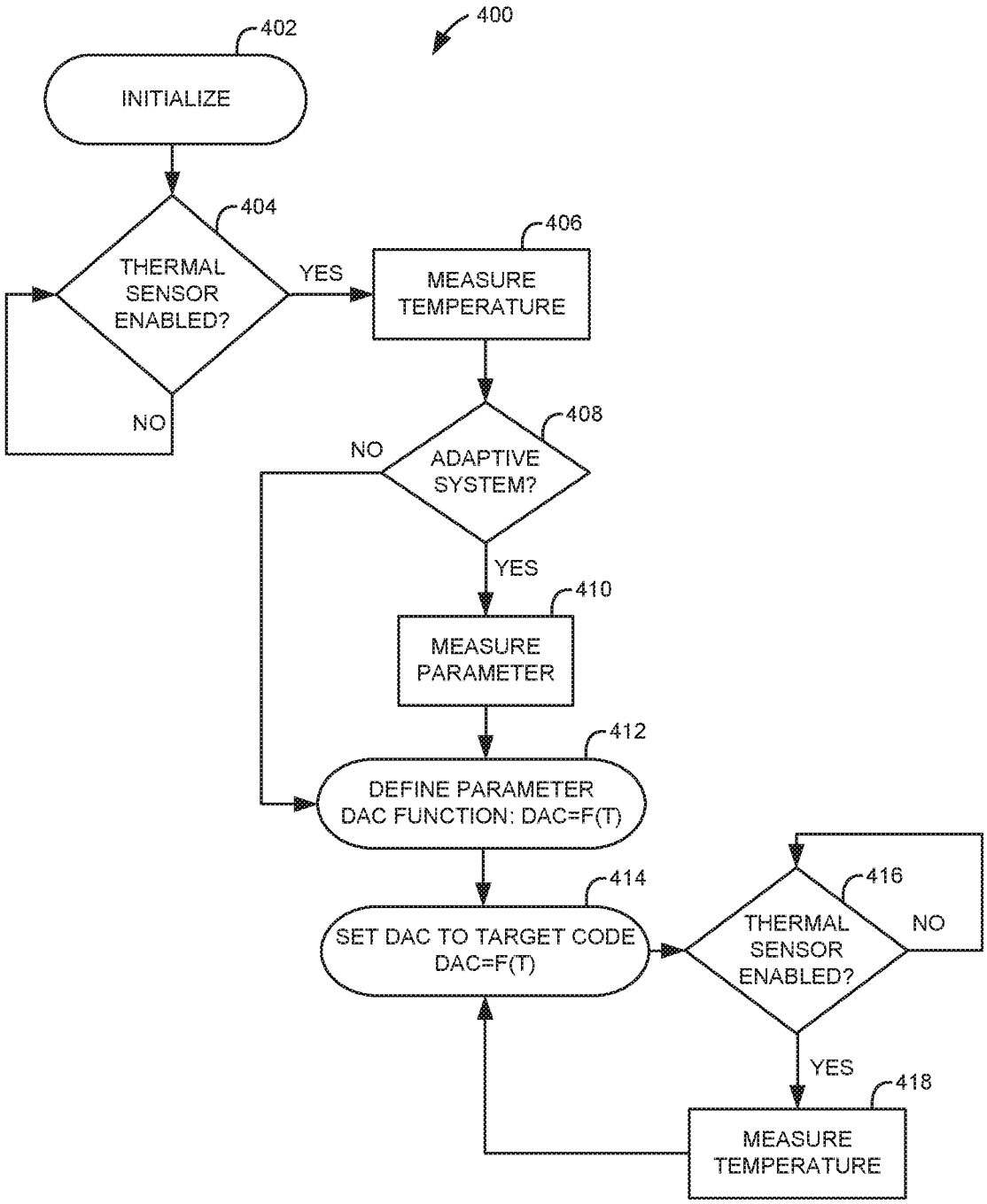
FIG. 6 is a flow diagram illustrating another example of a method for emulating a parameter of a fluid ejection die.

FIG. 6 is a flow diagram illustrating another example of a method 400 for emulating a parameter of a fluid ejection die. In one example, method 400 may be implemented by integrated circuit 100 of FIG. 1, integrated circuit 120 of FIG. 2, or integrated circuit 200 of FIG. 3. Method 400 is initialized at 402. In response to the initialization, at 404 method 400 determines whether a thermal sensor for the fluid ejection die is enabled. In response to the thermal sensor not being enabled, method 400 waits and continues to check whether the thermal sensor is enabled. Once the thermal sensor is enabled, at 406 method 400 measures the temperature of the fluid ejection die.

At 408, method 400 determines whether the system is an adaptive system or a non-adaptive system. An non-adaptive system, for example, is a system where sense input interface 270 or 272 (FIG. 3) does not measure a parameter to be emulated and a parameter is emulated (e.g., via sense output interface 278 or 280) based on expected values versus temperature (e.g., look up table inputs are based on temperature). An adaptive system, for example, is a system where sense input interface 270 or 272 receives a parameter to be emulated and the parameter is measured (e.g., via sense input interface 270 or 272) and then modified based on temperature (e.g., via a linear or nonlinear equation) and the parameter is emulated on sense output interface 278 or 280.

In response to determining that the system is an adaptive system, at 410 method 400 measures the parameter to be emulated. In response to determining that the system is not an adaptive system or after measuring the parameter at 410, at 412 method 400 defines the emulated parameter such that a DAC function equals a function of temperature (T), i.e., DAC=F(T). This completes the initialization of the parameter emulation.

The remaining portion of method 400 describes the thermal loop control. At 414, the DAC is set to the target code based on the measured temperature, i.e., DAC=F(T). At 416, method 400 determines whether the thermal sensor for the fluid ejection die is enabled. In response to the thermal sensor not being enabled, method 400 waits and continues to check whether the thermal sensor is enabled. Once the thermal sensor is enabled, at 418 method 400 measures the temperature of the fluid ejection die. At 414, method 400 sets the DAC to the target code based on the measured temperature. The thermal loop control of method 400 then repeats at 416.

Figure 7:
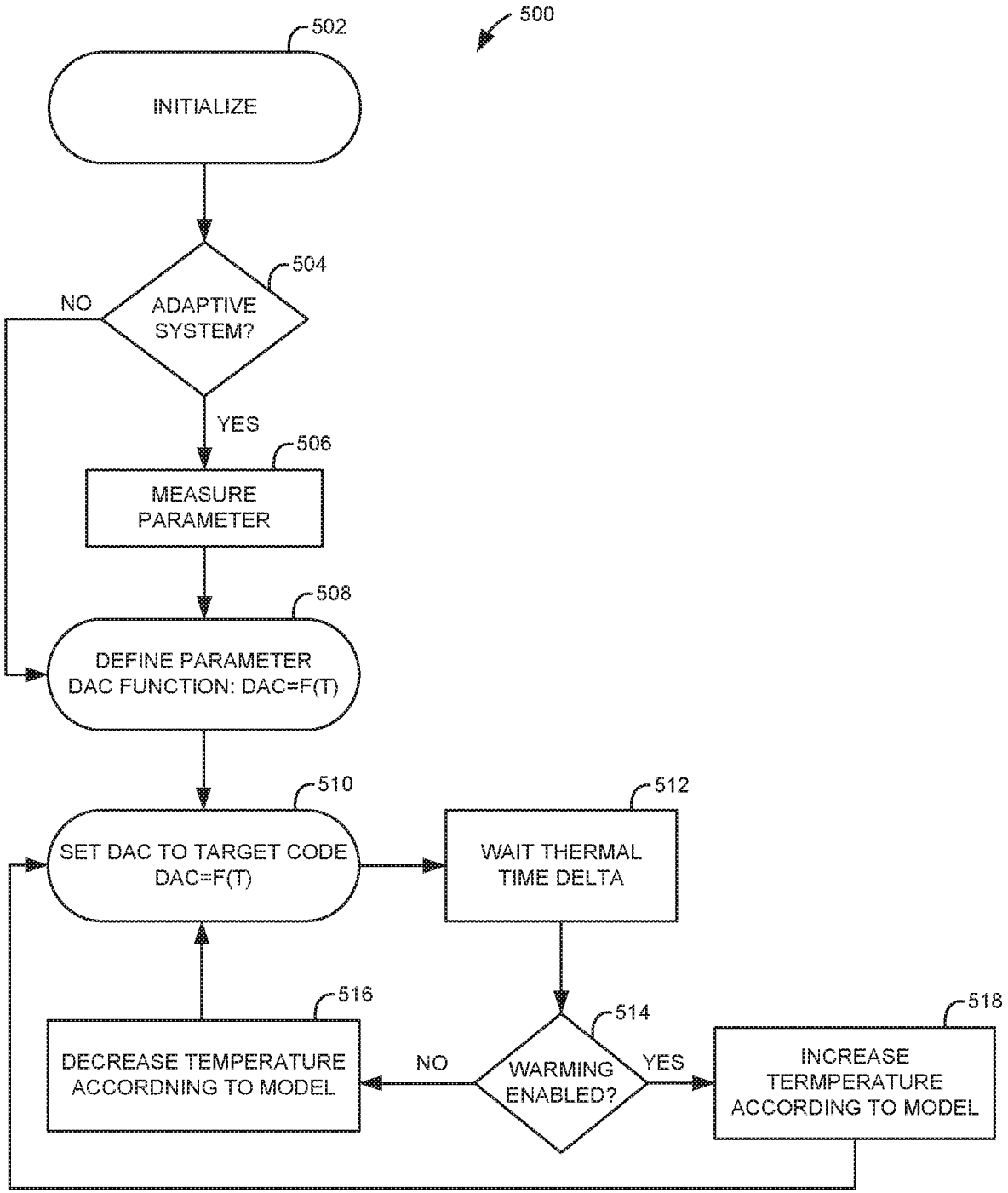
FIG. 7 is a flow diagram illustrating another example of a method for emulating a parameter of a fluid ejection die.

FIG. 7 is a flow diagram illustrating another example of a method 500 for emulating a parameter of a fluid ejection die. In one example, method 500 may be implemented by integrated circuit 100 of FIG. 1, integrated circuit 120 of FIG. 2, or integrated circuit 200 of FIG. 3. Method 500 is initialized at 502. In response to the initialization, at 504 method 500 determines whether the system is an adaptive system or a non-adaptive system as previously described above with reference to FIG. 6. In response to determining that the system is an adaptive system, at 506 method 500 measures the parameter to be emulated. In response to determining that the system is not an adaptive system or after measuring the parameter at 506, at 508 method 500 defines the parameter such that a DAC function equals a function of temperature (T), i.e., DAC=F(T). This completes the initialization of the parameter emulation.

The remaining portion of method 500 describes the thermal loop control. At 510, the DAC is set to the target code based on the estimated temperature, i.e., DAC=F(T). At 512, method 500 waits a thermal time delta. At 514, method 500 determines whether warming of the fluid ejection die is enabled or disabled. In response to warming not being enabled, at 516 method 500 decreases the estimated temperature according to a thermal model. Then at 510, method 500 sets the DAC to the target code based on the decreased estimated temperature. In response to warming being enabled, at 518 method 500 increases the estimated temperature according to the thermal model. Then at 510, method 500 sets the DAC to the target code based on the increased estimated temperature. The thermal loop control of method 500 then repeats at 512.

Figure 8A:
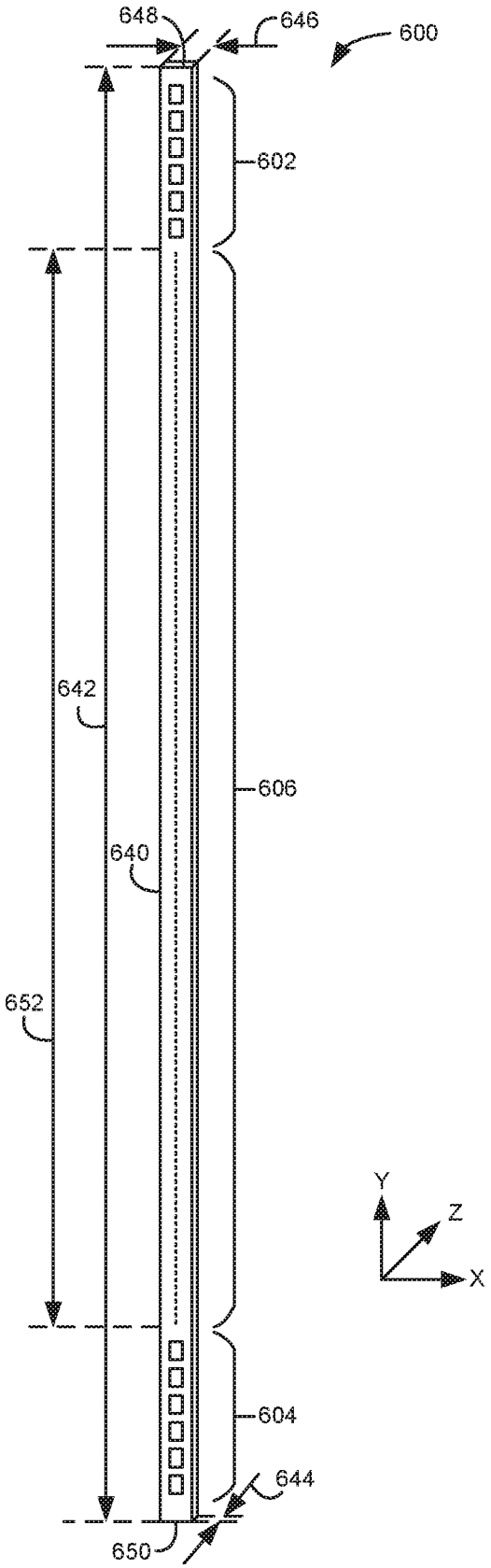
FIGS. 8A and 8B illustrate one example of a fluid ejection die.
Figure 8B:
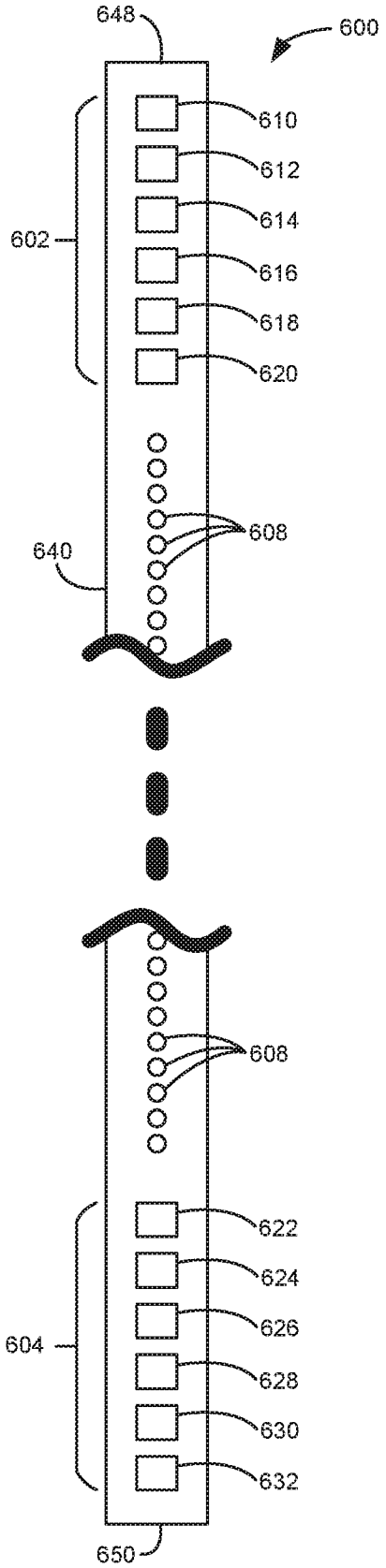

FIG. 8A illustrates one example of a fluid ejection die 600 and FIG. 8B illustrates an enlarged view of the ends of fluid ejection die 600. Die 600 includes a first column 602 of contact pads, a second column 604 of contact pads, and a column 606 of fluid actuation devices 608. The second column 604 of contact pads is aligned with the first column 602 of contact pads and at a distance (i.e., along the Y axis) from the first column 602 of contact pads. The column 606 of fluid actuation devices 608 is disposed longitudinally to the first column 602 of contact pads and the second column 604 of contact pads. The column 606 of fluid actuation devices 608 is also arranged between the first column 602 of contact pads and the second column 604 of contact pads. In one example, fluid actuation devices 608 are nozzles or fluidic pumps to eject fluid drops.

In one example, the first column 602 of contact pads includes six contact pads. The first column 602 of contact pads may include the following contact pads in order: a data contact pad 610, a clock contact pad 612, a logic power ground return contact pad 614, a multipurpose input/output contact pad 616, a first high voltage power supply contact pad 618, and a first high voltage power ground return contact pad 620. Therefore, the first column 602 of contact pads includes the data contact pad 610 at the top of the first column 602, the first high voltage power ground return contact pad 620 at the bottom of the first column 602, and the first high voltage power supply contact pad 618 directly above the first high voltage power ground return contact pad 620. While contact pads 610, 612, 614, 616, 618, and 620 are illustrated in a particular order, in other examples the contact pads may be arranged in a different order.

In one example, the second column 604 of contact pads includes six contact pads. The second column 604 of contact pads may include the following contact pads in order: a second high voltage power ground return contact pad 622, a second high voltage power supply contact pad 624, a logic reset contact pad 626, a logic power supply contact pad 628, a mode contact pad 630, and a fire contact pad 632. Therefore, the second column 604 of contact pads includes the second high voltage power ground return contact pad 622 at the top of the second column 604, the second high voltage power supply contact pad 624 directly below the second high voltage power ground return contact pad 622, and the fire contact pad 632 at the bottom of the second column 604. While contact pads 622, 624, 626, 628, 630, and 632 are illustrated in a particular order, in other examples the contact pads may be arranged in a different order.

Data contact pad 610 may be used to input serial data to die 600 for selecting fluid actuation devices, memory bits, thermal sensors, configuration modes (e.g. via a configuration register), etc. Data contact pad 610 may also be used to output serial data from die 600 for reading memory bits, configuration modes, status information (e.g., via a status register), etc. Clock contact pad 612 may be used to input a clock signal to die 600 to shift serial data on data contact pad 610 into the die or to shift serial data out of the die to data contact pad 610. Logic power ground return contact pad 614 provides a ground return path for logic power (e.g., about 0 V) supplied to die 600. In one example, logic power ground return contact pad 614 is electrically coupled to the semiconductor (e.g., silicon) substrate 640 of die 600. Multipurpose input/output contact pad 616 may be used for analog sensing and/or digital test modes of die 600. In one example, multipurpose input/output contact pad 616 may be electrically coupled to input interface 144 or 146 of FIG. 2 or sense input interface 270 or 272 of FIG. 3.

First high voltage power supply contact pad 618 and second high voltage power supply contact pad 624 may be used to supply high voltage (e.g., about 32 V) to die 600. First high voltage power ground return contact pad 620 and second high voltage power ground return contact pad 622 may be used to provide a power ground return (e.g., about 0 V) for the high voltage power supply. The high voltage power ground return contact pads 620 and 622 are not directly electrically connected to the semiconductor substrate 640 of die 600. The specific contact pad order with the high voltage power supply contact pads 618 and 624 and the high voltage power ground return contact pads 620 and 622 as the innermost contact pads may improve power delivery to die 600. Having the high voltage power ground return contact pads 620 and 622 at the bottom of the first column 602 and at the top of the second column 604, respectively, may improve reliability for manufacturing and may improve ink shorts protection.

Logic reset contact pad 626 may be used as a logic reset input to control the operating state of die 600. Logic power supply contact pad 628 may be used to supply logic power (e.g., between about 1.8 V and 15 V, such as 5.6 V) to die 600. Mode contact pad 630 may be used as a logic input to control access to enable/disable configuration modes (i.e., functional modes) of die 600. Fire contact pad 632 may be used as a logic input to latch loaded data from data contact pad 610 and to enable fluid actuation devices or memory elements of die 600.

Die 600 includes an elongate substrate 640 having a length 642 (along the Y axis), a thickness 644 (along the Z axis), and a width 646 (along the X axis). In one example, the length 642 is at least twenty times the width 646. The width 646 may be 1 mm or less and the thickness 644 may be less than 500 microns. The fluid actuation devices 608 (e.g., fluid actuation logic) and contact pads 610-632 are provided on the elongate substrate 640 and are arranged along the length 642 of the elongate substrate. Fluid actuation devices 608 have a swath length 652 less than the length 642 of the elongate substrate 640. In one example, the swath length 652 is at least 1.2 cm. The contact pads 610-632 may be electrically coupled to the fluid actuation logic. The first column 602 of contact pads may be arranged near a first longitudinal end 648 of the elongate substrate 640. The second column 604 of contact pads may be arranged near a second longitudinal end 650 of the elongate substrate 640 opposite to the first longitudinal end 648.

Figure 9:
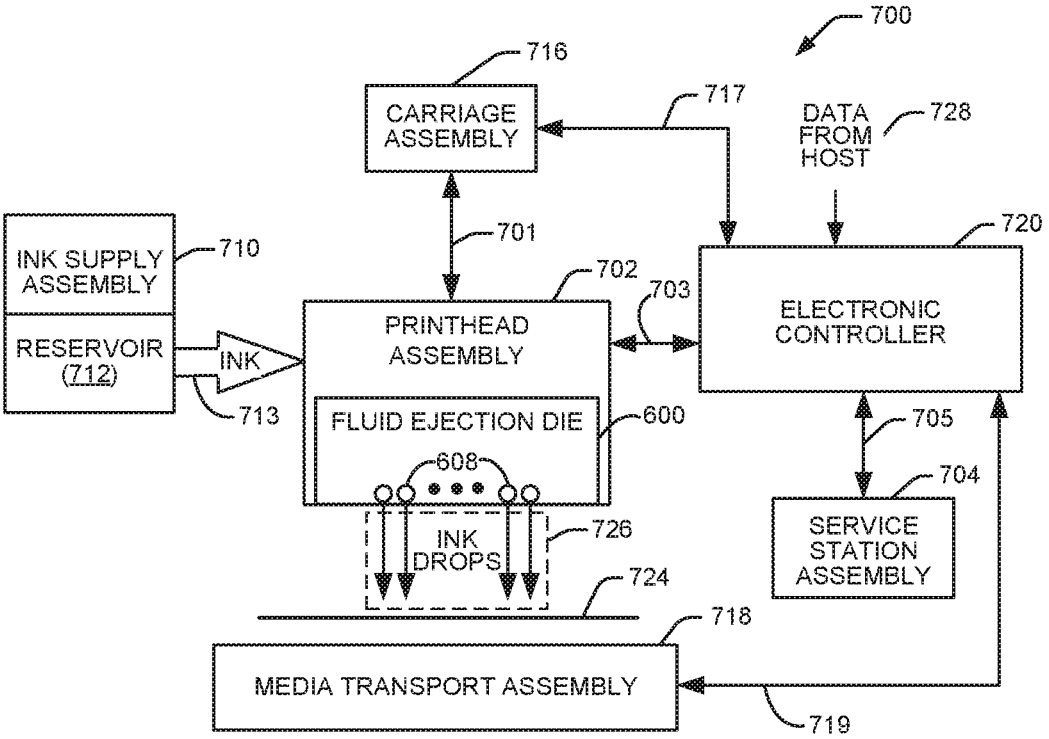
FIG. 9 is a block diagram illustrating one example of a fluid ejection system.

FIG. 9 is a block diagram illustrating one example of a fluid ejection system 700. Fluid ejection system 700 includes a fluid ejection assembly, such as printhead assembly 702, and a fluid supply assembly, such as ink supply assembly 710. In the illustrated example, fluid ejection system 700 also includes a service station assembly 704, a carriage assembly 716, a print media transport assembly 718, and an electronic controller 720. While the following description provides examples of systems and assemblies for fluid handling with regard to ink, the disclosed systems and assemblies are also applicable to the handling of fluids other than ink.

Printhead assembly 702 includes at least one printhead or fluid ejection die 600 previously described and illustrated with reference to FIGS. 8A and 8B, which ejects drops of ink or fluid through a plurality of orifices or nozzles 608. In one example, the drops are directed toward a medium, such as print media 724, so as to print onto print media 724. In one example, print media 724 includes any type of suitable sheet material, such as paper, card stock, transparencies, Mylar, fabric, and the like. In another example, print media 724 includes media for three-dimensional (3D) printing, such as a powder bed, or media for bioprinting and/or drug discovery testing, such as a reservoir or container. In one example, nozzles 608 are arranged in at least one column or array such that properly sequenced ejection of ink from nozzles 608 causes characters, symbols, and/or other graphics or images to be printed upon print media 724 as printhead assembly 702 and print media 724 are moved relative to each other.

Ink supply assembly 710 supplies ink to printhead assembly 702 and includes a reservoir 712 for storing ink. As such, in one example, ink flows from reservoir 712 to printhead assembly 702. In one example, printhead assembly 702 and ink supply assembly 710 are housed together in an inkjet or fluid-jet print cartridge or pen. In another example, ink supply assembly 710 is separate from printhead assembly 702 and supplies ink to printhead assembly 702 through an interface connection 713, such as a supply tube and/or valve.

Carriage assembly 716 positions printhead assembly 702 relative to print media transport assembly 718, and print media transport assembly 718 positions print media 724 relative to printhead assembly 702. Thus, a print zone 726 is defined adjacent to nozzles 608 in an area between printhead assembly 702 and print media 724. In one example, printhead assembly 702 is a scanning type printhead assembly such that carriage assembly 716 moves printhead assembly 702 relative to print media transport assembly 718. In another example, printhead assembly 702 is a non-scanning type printhead assembly such that carriage assembly 716 fixes printhead assembly 702 at a prescribed position relative to print media transport assembly 718.

Service station assembly 704 provides for spitting, wiping, capping, and/or priming of printhead assembly 702 to maintain the functionality of printhead assembly 702 and, more specifically, nozzles 608. For example, service station assembly 704 may include a rubber blade or wiper which is periodically passed over printhead assembly 702 to wipe and clean nozzles 608 of excess ink. In addition, service station assembly 704 may include a cap that covers printhead assembly 702 to protect nozzles 608 from drying out during periods of non-use. In addition, service station assembly 704 may include a spittoon into which printhead assembly 702 ejects ink during spits to ensure that reservoir 712 maintains an appropriate level of pressure and fluidity, and to ensure that nozzles 608 do not clog or weep. Functions of service station assembly 704 may include relative motion between service station assembly 704 and printhead assembly 702.

Electronic controller 720 communicates with printhead assembly 702 through a communication path 703, service station assembly 704 through a communication path 705, carriage assembly 716 through a communication path 717, and print media transport assembly 718 through a communication path 719. In one example, when printhead assembly 702 is mounted in carriage assembly 716, electronic controller 720 and printhead assembly 702 may communicate via carriage assembly 716 through a communication path 701. Electronic controller 720 may also communicate with ink supply assembly 710 such that, in one implementation, a new (or used) ink supply may be detected.

Electronic controller 720 receives data 728 from a host system, such as a computer, and may include memory for temporarily storing data 728. Data 728 may be sent to fluid ejection system 700 along an electronic, infrared, optical or other information transfer path. Data 728 represent, for example, a document and/or file to be printed. As such, data 728 form a print job for fluid ejection system 700 and includes at least one print job command and/or command parameter.

In one example, electronic controller 720 provides control of printhead assembly 702 including timing control for ejection of ink drops from nozzles 608. As such, electronic controller 720 defines a pattern of ejected ink drops which form characters, symbols, and/or other graphics or images on print media 724. Timing control and, therefore, the pattern of ejected ink drops, is determined by the print job commands and/or command parameters. In one example, logic and drive circuitry forming a portion of electronic controller 720 is located on printhead assembly 702. In another example, logic and drive circuitry forming a portion of electronic controller 720 is located off printhead assembly 702.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. An integrated circuit comprising:

thermal tracking logic to determine a temperature of a fluid ejection die;

control logic to define an emulated parameter of the fluid ejection die as a function of the temperature of the fluid ejection die;

an output interface to output the emulated parameter to a printer system based on the function and the temperature of the fluid ejection die;

a plurality of input interfaces to measure a parameter of the fluid ejection die to be emulated;

a control interface; and a multiplexer to select one of the plurality of input interfaces based on a control signal on the control interface, wherein the control logic is to modify the measured parameter based on the temperature of the fluid ejection die to define the emulated parameter as the function of the temperature of the fluid ejection die.

2. The integrated circuit of claim 1, wherein the thermal tracking logic is to measure the temperature of the fluid ejection die.

3. The integrated circuit of claim 1, wherein the thermal tracking logic is to estimate the temperature of the fluid ejection die based on a thermal model.

4. The integrated circuit of claim 1, wherein the emulated parameter comprises a resistance, a voltage, or a current.

5. The integrated circuit of claim 1, further comprising:

a voltage mode digital to analog converter, a current mode digital to analog converter, a transconductance amplifier, or a digital potentiometer to output the emulated parameter on the output interface.

6. An integrated circuit comprising:

thermal tracking logic to determine a temperature of a fluid ejection die;

control logic to define an emulated parameter of the fluid ejection die as a function of the temperature of the fluid ejection die;

an output interface to output the emulated parameter to a printer system based on the function and the temperature of the fluid ejection die;

a control interface; and a multiplexer to output one of a plurality of emulated parameters on the output interface based on a control signal on the control interface.

7. The integrated circuit of claim 6, wherein the emulated parameter comprises a resistance, a voltage, or a current.

8. The integrated circuit of claim 6, wherein the thermal tracking logic is to measure the temperature of the fluid ejection die.

9. The integrated circuit of claim 6, wherein the thermal tracking logic is to estimate the temperature of the fluid ejection die based on a thermal model.

10. The integrated circuit of claim 6, further comprising:

a voltage mode digital to analog converter, a current mode digital to analog converter, a transconductance amplifier, or a digital potentiometer to output the emulated parameter on the output interface.

* * * * *